US006915947B2

(12) United States Patent
Siurek et al.

(10) Patent No.: US 6,915,947 B2
(45) Date of Patent: Jul. 12, 2005

(54) ADJUSTABLE WIDTH PAPERBOARD TOTE TRAY

(75) Inventors: Brandon Winford Siurek, Munster, IN (US); Anthony Louis Sorci, Chicago Ridge, IL (US)

(73) Assignee: The Packaging House, Chicago, IL (US)

( * ) Notice: Subject to any disclaimer, the term of this patent is extended or adjusted under 35 U.S.C. 154(b) by 0 days.

(21) Appl. No.: 10/435,876

(22) Filed: May 12, 2003

(65) Prior Publication Data

US 2004/0226987 A1 Nov. 18, 2004

(51) Int. Cl.[7] ..... B65D 5/00
(52) U.S. Cl. ..... 229/101; 229/164; 229/165
(58) Field of Search ..... 229/101, 122.1, 229/122.21, 125.28, 125.26, 125.27, 164, 165; 220/8

(56) References Cited

U.S. PATENT DOCUMENTS 655,939 A * 8/1900 Overton ..... 229/101
2,941,670 A * 6/1960 Fagan et al. ..... 211/49.1
2,948,624 A * 8/1960 Watson et al. ..... 426/111
2,984,624 A 5/1961 Halter et al.
3,700,159 A * 10/1972 Beigel ..... 229/101
3,887,102 A 6/1975 Earley
4,523,675 A * 6/1985 Schroter ..... 206/764
5,192,019 A 3/1993 Meehan
6,227,438 B1 * 5/2001 Hiltke ..... 229/101

FOREIGN PATENT DOCUMENTS

FR 2639913 6/1990

* cited by examiner

*Primary Examiner*—Tri M. Mai
(74) *Attorney, Agent, or Firm*—Jones Day

(57) ABSTRACT

A novel adjustable width paperboard or corrugated paper tray having a tray telescopically associated with a tray support. Engagement devices, preferably in the form of a plurality of spaced serrations or triangular shaped projections associated with each inner wall of the tray support and with the inner wall of the tray, are integrally formed with the tray and the tray support and matingly engage with each other in a fashion that can be disengaged so that the tray can be moved to a desired width and the serrations re-engaged to lock the tray in the desired position.

23 Claims, 4 Drawing Sheets

ADJUSTABLE WIDTH PAPERBOARD TOTE TRAY

BACKGROUND OF THE INVENTION

1. Field of the Invention

The present invention relates in general to paperboard or corrugated paper trays and, in particular, to an adjustable width paperboard or corrugated paper tote tray.

2. Description of Related Art

Paperboard or corrugated paper trays are well known in the art and, in some cases, are known by the name "tote" trays. They are used for displaying packaged articles for sale and, because they are generally of a relatively small size, can be carried to various locations for display purposes As noted in U.S. Pat. No. 6,227,438 B1, such trays are normally of a fixed width and there is no way to vary the width of the tray. An expandable width tray is then disclosed in U.S. Pat. No. 6,227,438 B1 ('438 patent).

However, in the '438 patent, there is not disclosed any manner of fixing the width of the tray at any selected width. It is true that the width can be adjusted but there is nothing disclosed in the '438 patent for holding the tray in any selected width position. The tray simply slides in and out of the tray support from a minimum width to a maximum width.

Adjustable length package product display units are disclosed in U.S. Pat. No. 3,887,102; U.S. Pat. No. 2,948,624; and in French Patent No. 2 639 913. However, none of these patents disclose means to fixedly hold the tray in any selected position. This, of course, means that the tray can inadvertently slide out of its selected position. This is not a desirable condition inasmuch as the tray can either slide entirely out of the tray support or it may slide to some position that would create a larger tray than the product it is intended to hold thus creating an untidy looking display. Further, if any undue pressure is applied to the front of the tray, it can be pressed in against the packaged product that has been placed in the tray.

A package product display box is disclosed in U.S. Pat. No. 5,192,019 that does enable the tray to be extended to some desirable position and then locked, or fixed, in that position. This is accomplished by forming a series of spaced orifices in both the tray support walls and the tray walls in aligned relationship. When the tray is extended to some desired position, the nearest two aligned orifices have a pin inserted in them and the tray is then locked in the desired position.

This product display box also has a significant disadvantage. If the pins are lost or misplaced, the display box is not able to be locked in the desired fixed position.

It would be desirable to have a tote tray having integrally formed interlocking means that can be used to lock the tray in any one of a plurality of extended positions without the requirement of pins or additional materials.

SUMMARY OF THE INVENTION

The present invention overcomes the disadvantages of the prior art by providing an adjustable width tote tray that has a tray support and a tray telescopically associated with each other. Both the tray support and the tray itself have side walls. Each of the side walls of the tray support is formed with an inner wall and an outer wall with a space between them. The inner wall has a lower portion that extends only partially down the side of the outer wall. The corresponding side walls of the tray have an inner and an outer portion and are telescopically inserted in corresponding spaces in the side walls of the tray support.

Spaced projections are integrally formed with the lower portion of the inner wall of each side wall of the tray support. Corresponding spaced projections are integrally formed with the inner wall of each side wall of the tray. These projections function as interlocking means and can matingly engage with each other in any one of a like plurality of extended positions to lock the tray in a selected position in relation to the tray support. No external devices such as pins or clips are required to lock the tray to said tray support. The projections, in the preferred embodiment, are triangular shaped and lock with each other in a meshed relationship.

Thus, it is an object of the invention to provide an adjustable width paperboard or corrugated paper tote tray having a tray that can be locked in any one of a number of selected positions with relation to the tray support without the use of external devices such as pins or clips.

It is another object of the present invention to provide an adjustable width tray having engagement means integrally formed with each side wall of a tray support and congruent engagement means integrally formed with the tray support such that when a tray is telescopically engaged with the tray support, the engagement means integrally formed with each tray support side wall meshes with the congruent engagement means integrally formed with corresponding ones of the tray side walls to form a self-contained mechanism that will lock the tray to the tray support in its selected position.

It is still another object of the present invention to form the engagement means in the form of projections associated with the tray support side walls and the tray side walls.

It is an object of the present invention to form the projections as triangular shapes.

It is also an object of the present invention to form the adjustable tray of paperboard or corrugated paper.

Thus, the invention relates to an adjustable width tray comprising a tray support having a generally rectangular shape and having at least opposing side walls and an integrally formed rear wall and a first plurality of spaced engagement means integrally formed with each of the opposing side walls; a tray having a generally rectangular shape and having at least opposing side walls and an integrally formed front wall, the tray having dimensions sufficient to enable telescopic insertion of the tray in side wall-to-side wall relationship with the tray support; and a plurality of second spaced engagement means integrally formed with each of the corresponding opposing side walls of said tray for removable mating engagement with said first plurality of spaced projections integrally formed with the tray support side walls in a plurality of tray width positions to form an adjustable width tray.

BRIEF DESCRIPTION OF THE DRAWINGS

These and other objects of the present invention will be more fully disclosed when taken in conjunction with the following detailed description of the drawings in which like numerals represent like elements and in which.

DETAILED DESCRIPTION OF THE DRAWINGS

Figure 1:
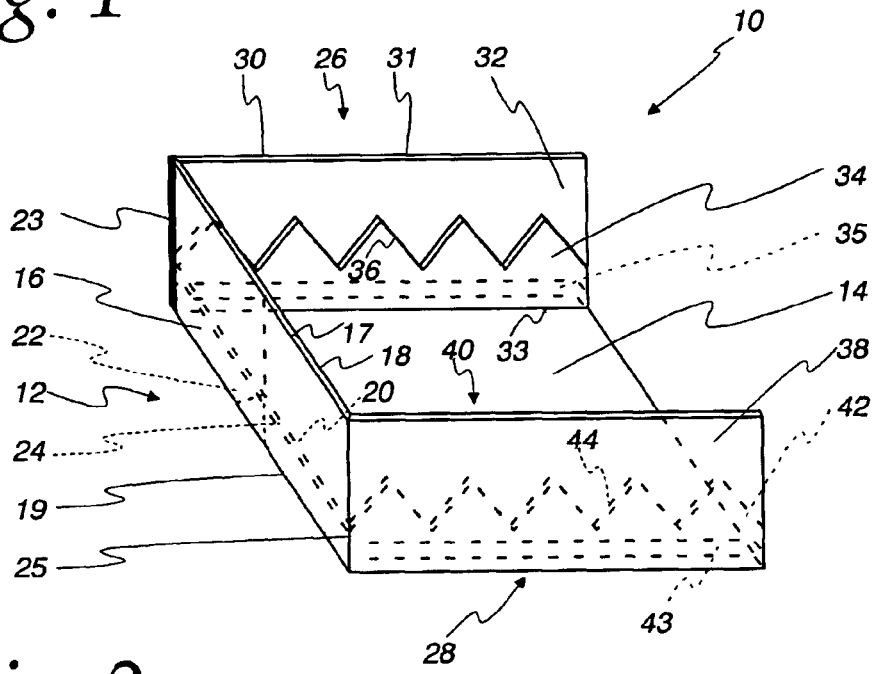
FIG. 1 is a perspective view of the tray of the present invention illustrating the locking engagement means integrally formed with each inner wall of each side wall (one inner side wall being in phantom lines)

FIG. 1 is a perspective view of the tray 10 standing alone. It has a front wall or panel 12 with an integrally formed bottom panel 14 and integrally formed opposing side walls 26 and 28.

Front wall 12 is formed of outer wall 16 and an inner wall 18 that is folded over outer wall 16 about fold line 17. Strength is added to the front wall 12 by flaps 22 and 24 that are folded over fold lines 23 and 25 respectively. The flaps 22 and 24 are held in place by extended panel or lip 22 that is folded under flaps 22 and 24 about fold line 19. Flaps 22 and 24 are integrally formed with side walls 26 and 28 by fold lines 23 and 25 respectively and they hold side walls 26 and 28 in vertical orientation as shown.

Figure 4:
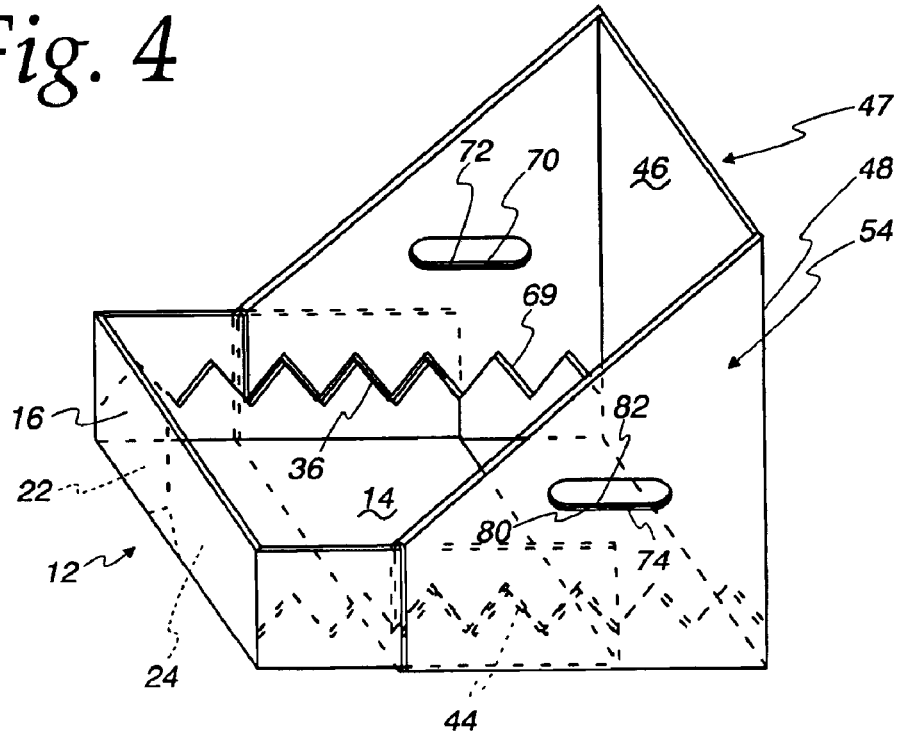
FIG. 4 is a perspective view of the novel adjustable width tray in a partially extended position and illustrating how the tray is locked in one extended position with the tray support, by the meshing arrangement of the engagement means integrally associated with each of the side walls of the tray and each of the side walls of the tray support.
Figure 5:
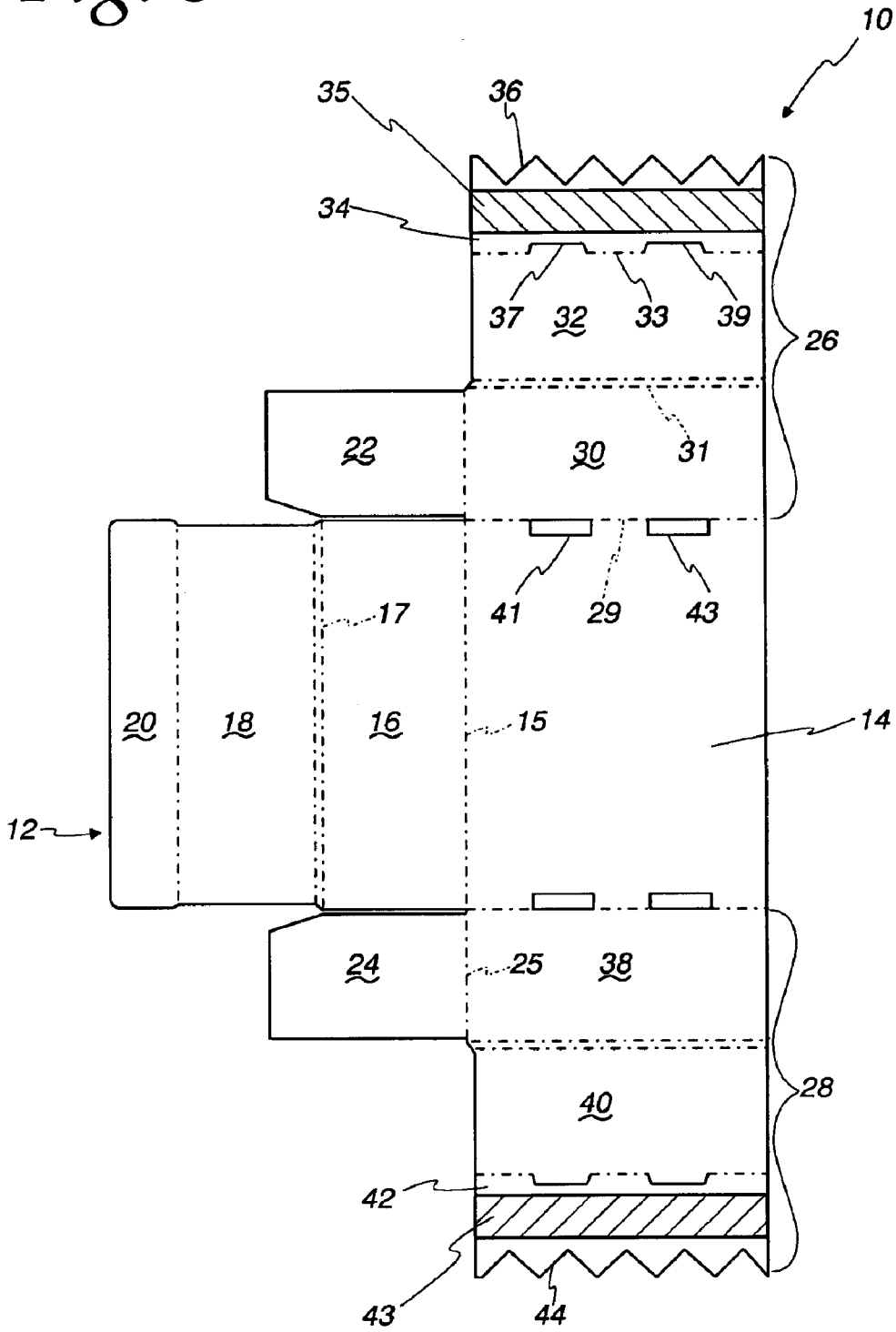
FIG. 5 is a plan view of the paperboard or corrugated paper blank used to form the novel tray by folding the various panels about their respective fold lines.

Side wall 26 comprises an outer wall 30 that is folded upwardly about score line 29 (See FIG. 5). It also has an inner wall 32 that is folded about score line 31 to extend downwardly to bottom panel 14. A lip 34 is folded upwardly about score line 33 with a glue strip 35 on the inside thereof to attach lip 34 to inner wall 32 in fixed relationship. Projections 37 and 39 (FIG. 5) are formed on fold line 33 and are inserted in corresponding slots 41 and 43 associated with score line 29. In the preferred embodiment, a plurality of upwardly extending serrations or triangular shaped projections 36 are formed on, or associated with, the outer edge of lip 34 just above the glue strip 35. These triangular shaped projections 36 form the engagement means for interlocking with corresponding projections associated with the inner walls of the tray support as will be shown in relation to FIGS. 3 and 4. Since side wall 28 is the mirror image of side wall 26, it will not be discussed in detail because it is formed in the same way as side wall 26.

Figure 2:
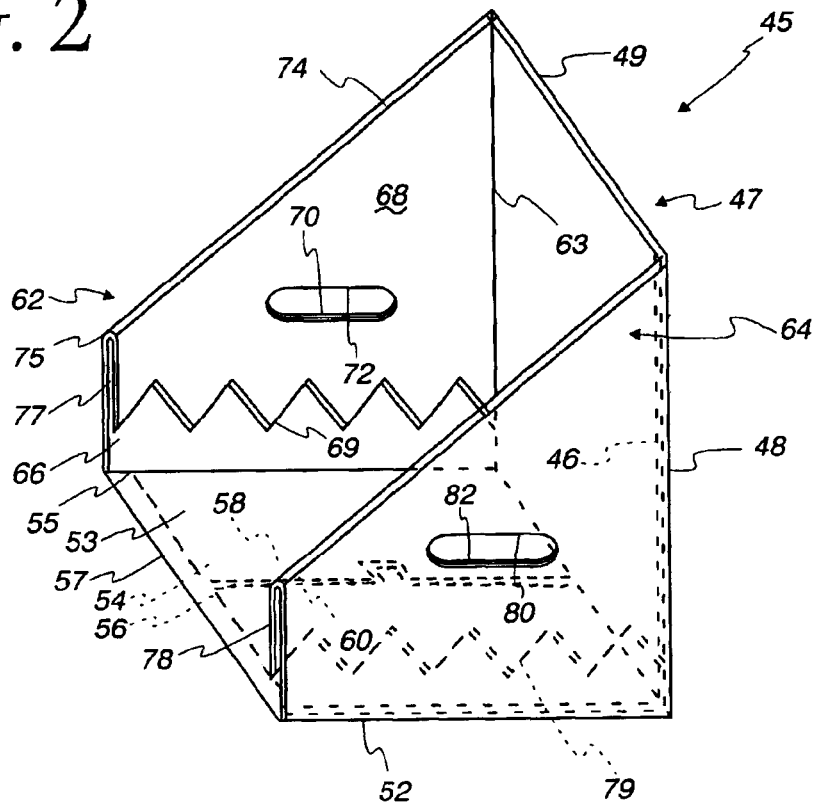
FIG. 2 is a perspective view of the tray support of the present invention illustrating the inner walls thereof (with one inner side wall being in phantom lines) and the mating congruent locking engagement means integrally associated with the lower portion of each inner wall of each side wall of the tray support.

FIG. 2 is a perspective view of the novel tray support 45 of the present invention. In the preferred embodiment, tray support 45 is comprised of a bottom wall formed of panel 52 with overlapping bottom flap 53 coupled thereto by score line 57, a rear wall 47, and opposing side walls 62 and 64. By reviewing the paperboard or corrugated paper blank shown in FIG. 6 that is used to form tray support 45, it can be seen that rear wall 47 is formed of an outer wall 48 and an inner wall 46. Inner wall 46 is folded over outer wall 48 about score line 49. Since side wall 64 is the mirror image of side wall 62, only side wall 62 will be discussed in detail. Side wall 62 is formed by folding side panel 66 upwardly about score line 63 (see FIG. 6). Flap 54 is folded about score line 55 and is inserted between inner bottom and outer bottom panels 52 and 53 that form the bottom of support tray 45. Flap 54 has a truncated-cone shaped recess 58 that receives a corresponding congruent truncated-cone projection 60 on flap 56 of side wall 64 to lock the flaps 54 and 56 together to hold the bottom panels 52 and 53 and side walls 62 and 64 in a relatively rigid relationship. Side wall 62 has an outer wall 66 and an inner wall 68 with inner wall 68 being folded over outer wall 66 about score line 74 (see FIG. 6). The upper edge or score line 74 slopes downwardly from rear wall 47 to the front edge 75. Score line 74 is such that when inner wall 68 is folded over outer wall 66, a space 77 is formed between the inner and outer walls 68 and 66, respectively.

The inner wall 68, when folded about score line 74, extends only partially downwardly toward bottom panels 52 and 53. At the lower end of inner wall 68, projections 69, preferably in the form of a plurality of downwardly extending serrations or triangular shapes, are integrally formed on, or otherwise associated with, the lower end of inner wall 68. This plurality of serrations, or triangular shapes 69, form the engagement means that intermesh with the corresponding serrations 36 on tray 10 to form the self-contained locking mechanism that will lock the tray 10 to the tray support 45 in a plurality of different widths as illustrated in FIG. 4.

The upper portion of side wall 26 of tray 10 is formed by the overlapped inner wall 32 and outer wall 30 and this portion is telescopically inserted in space 77 formed between the inner and outer walls 66 and 68 of the tray support 45. In this manner, the downwardly extending projections 69 associated with inner wall 68 of the tray support 45 can engage the upwardly extending projections 36 on lip 34 of the side wall 26 of the tray 10 and hold the tray 10 to the tray support 45 in any given one of a plurality of width positions.

Figure 6:
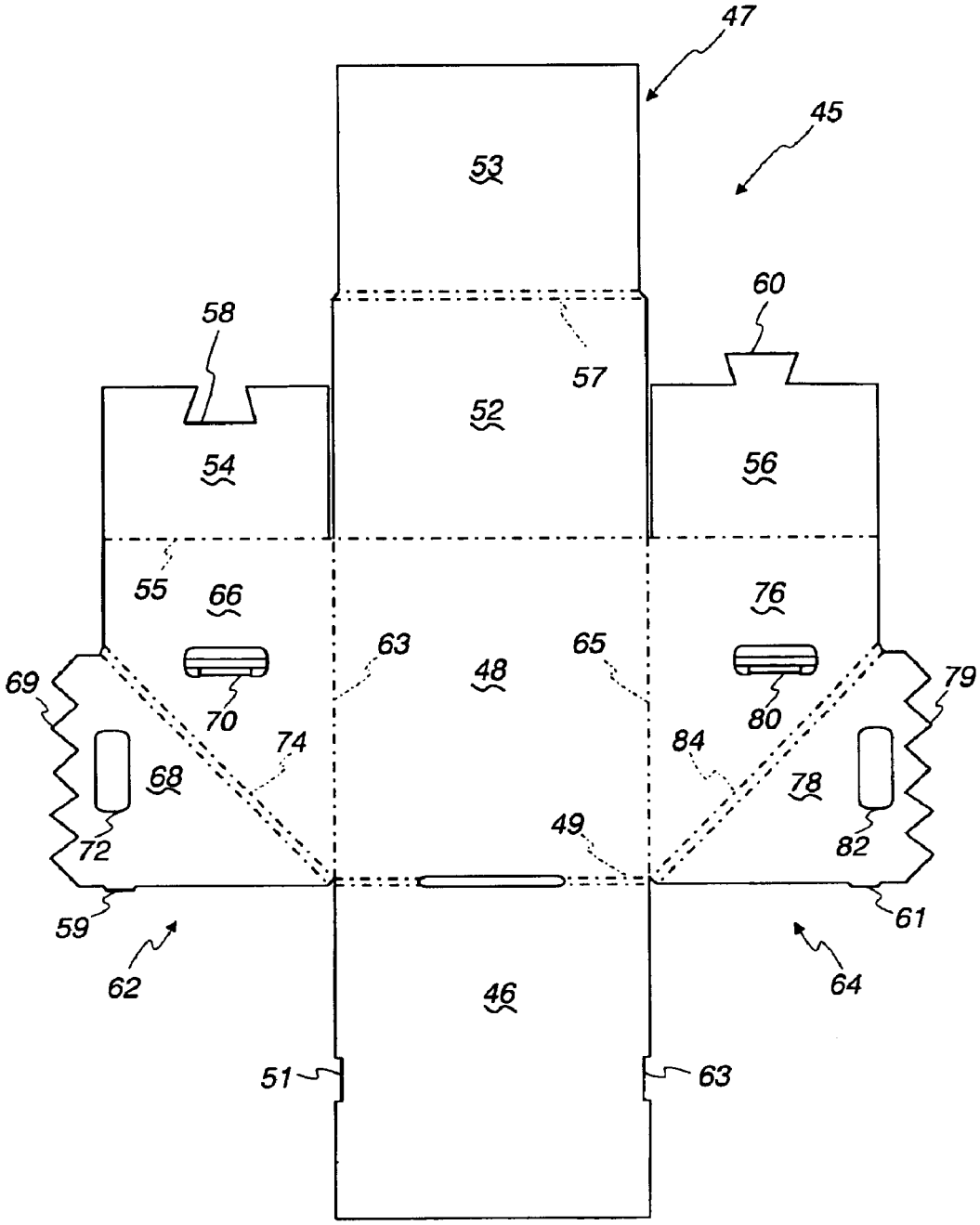
FIG. 6 is a plan view of the paperboard or corrugated paper blank used to form the novel tray support by folding the various panels about their respective fold lines.

A handle opening 72 is cut in the inner wall 68 and a corresponding handle opening 70 is cut in the outer wall 66 of the side wall 26 of tray support 45 (see FIG. 6) such that when inner panel 68 is folded over outer wall 66, the handle openings 70 and 72 are in superimposed relationship, thus forming a handle for gripping by a user of the novel adjustable width tray. As can be seen in FIG. 6, projections 59 and 61 on side walls 62 and 64 of the tray support 45 engage or are inserted in corresponding slots 51 and 63 in rear wall flap 46 to assist in holding the inner walls 68 and 78 substantially rigidly connected to the rear wall flap 46.

Figure 3:
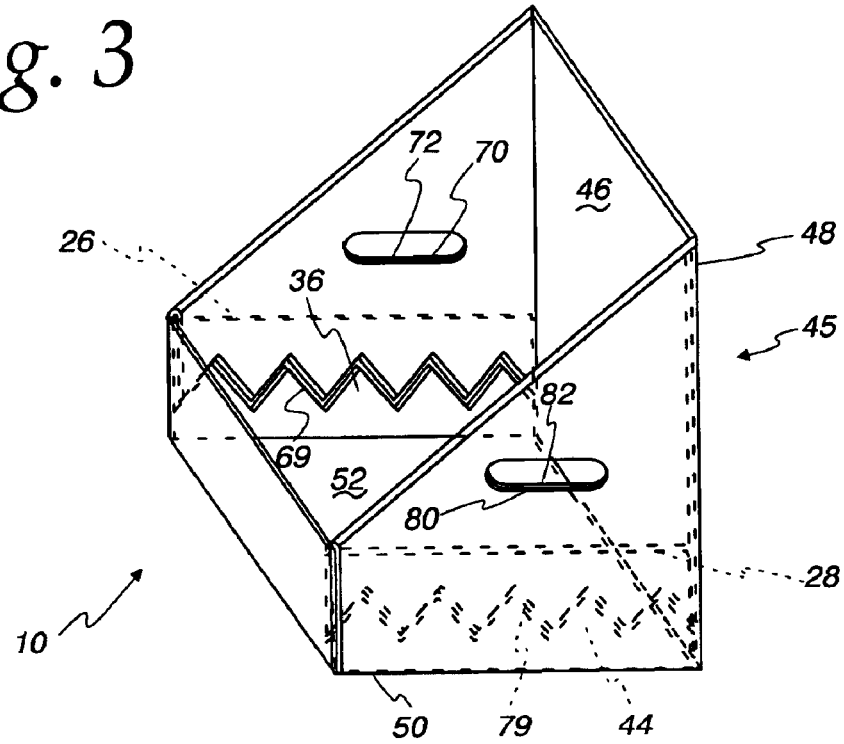
FIG. 3 is a perspective view of the novel adjustable width tray in its assembled state with the tray inserted in the tray support to its maximum width and illustrating the locking relationship of the engagement means on corresponding side walls of the tray and the tray support.

As can be seen in relation to FIGS. 3 and 4, the serrations or projections 36 and 69 are meshed with each other to hold the tray 10 at any desired width in tray support 45 such as a minimum width as shown in FIG. 3. The projections 36 and 69 can be disengaged and the tray 10 telescopically moved to a new position as shown in FIG. 4 and the projections 36 and 69 can be re-engaged as shown to lock the tray 10 to the tray support 45 in its new width position.

Because the tray 10 and tray support 45 are formed of paperboard or corrugated paper, the paperboard or corrugated paper is somewhat flexible thus allowing the projections to be engaged and disengaged.

Thus, with the present invention, an adjustable width product tray has been disclosed in which the width of the tray can be changed without the use of pins, clips, or other extraneous material. The engagement means are integrally formed with the tray and the tray support thus dispensing with the need of pins, clips, and the like. While the word "width" has been used herein, it is intended to encompass changes in depth or the like and is not used in a limiting manner.

It will be understood by those skilled in the art that various modifications can be made to the present invention without departing from the scope of the appended claims. The foregoing drawings and description are intended to be illustrative only and should not be construed in a limiting manner.

What is claimed is:

1. A paperboard or corrugated paper blank for forming a tray support for a tray, said tray and tray support forming an adjustable width paperboard or corrugated paper tray, said tray support paperboard or corrugated paper blank comprising a bottom wall, a rear wall, and opposing side walls integrally formed with each other and creating an open front, said tray support paperboard or corrugated paper blank comprising;

an outer rear wall having first, second, third, and fourth edges, and an inner rear wall panel connected to said outer panel by a first score line along a first edge of said outer rear wall panel and forming said rear wall when said outer rear wall panel is folded over said inner rear wall panel about said first score line;

an outer bottom panel having first and second opposed edges and an inner bottom panel connected to each other by a third score line along said one opposed edge and forming said bottom wall when said outer bottom panel is folded over said inner bottom panel about said third score line, said outer bottom panel being connected to said outer rear wall panel by a second score line along said second edge;

each of said first and second opposed side walls comprising an inner side wall panel and an outer side wall panel, said inner side wall panel having an outer edge and being integrally formed with said outer bottom panel third and fourth edges respectively about a fourth score line; and each of said inner side wall panels of said opposed side walls being joined to a corresponding one of said outer side wall panels by a fifth score line such that when said inner side wall panel is folded over said outer side wall panel about said fifth score line, said inner side wall panel outer edge is positioned so as to point downwards toward said bottom wall; and spaced projections formed on said inner side wall panel outer edge, said spaced projections mating with corresponding spaced projections on said tray to form said self-contained locking mechanism for said adjustable width paperboard or corrugated paper tray.

2. An adjustable width tray comprising:

a tray support having a generally rectangular shape and having at least opposing side walls and an integrally formed rear wall, and integrally formed first spaced engagement means associated with said opposing side walls;

a tray having a generally rectangular shape and having at least opposing side walls and an integrally formed front wall, said tray having dimensions sufficient to enable telescopic insertion of the tray in side wall-to-side wall relationship with said tray support;

a plurality of second spaced engagement means integrally formed with each of the corresponding opposing side walls of said tray for removable mating engagement with said first plurality of spaced engagement means integrally formed with said tray support side walls in a plurality of tray width positions to form an adjustable width tray;

a front edge on each of said side walls of said tray support;

an upper edge that slopes downwardly from said rear wall to said front edge; and each of said side walls of said tray support is comprised of an inner wall and an outer wall with a space between said inner wall and said outer wall.

3. The adjustable width tray of claim 2 wherein said opposing side walls of said tray are inserted in corresponding ones of said spaces formed between said inner wall and said outer wall of said tray support side walls.

4. The adjustable width tray of claim 3 further comprising:

said inner wall of said tray support side walls extending partially downwardly along said outer wall a predetermined distance to a lower edge, and said first plurality of spaced engagement means comprising projections being formed in relation to said lower edge of each of said inner walls of each tray support side wall for removable mating engagement with said second plurality of spaced engagement means of said corresponding side walls of said tray.

5. The adjustable width tray of claim 4 further comprising:

spaced triangular shaped teeth forming said first plurality of spaced projections and extending downwardly in relation to said lower edge of each of said inner walls of each of said tray support side walls for removable locking engagement with said second plurality of spaced projections on corresponding side walls of said tray.

6. The adjustable width tray of claim 5 further comprising:

a bottom wall integrally formed with said opposing side walls and said front wall of said tray, an inner wall on each of said opposing tray side walls, said inner wall extending partially upwardly in relation to said bottom wall and having an upper edge, and a spaced triangular spaced teeth forming said second plurality of spaced projections extending upwardly in relation to said upper edge of each of said inner walls of said tray for removable locking engagement with opposing ones of said first plurality of spaced triangular shaped teeth extending downwardly from each of said opposing inner side walls of said tray support thereby enabling said tray to be changed in position within said tray support by disengaging said opposing locked triangular teeth, moving said tray to a new position location, and relocking said opposed triangular teeth.

7. An adjustable width tray comprising:

a tray support having a bottom panel, a rear wall integrally formed with said bottom panel, first and second opposing side walls integrally formed with said bottom panel, each of said first and second opposing side walls being formed with spaced inner and outer walls, and first spaced engagement means having a first orientation and being formed on the inner wall of each of said opposing side walls, and a tray for telescopic insertion to an adjustable width within the spaced inner and outer walls of said tray support, said tray having a bottom panel, first and second opposing side walls integrally formed with said bottom panel, a front panel integrally formed with said bottom panel, and second spaced engagement means having a second orientation on an inner side of each of said first and second opposing walls in juxtaposition with said first spaced engagement means for removably and matingly engaging said first spaced engagement means on each opposed side wall of said tray support such that said tray may be made adjustable in position by disengaging said mating engagement of said tray and tray support, moving said tray to a new width position, and re-engaging said spaced engagement means on said tray support and said tray to lock said adjustable width tray in a new width position.

8. An adjustable width tray comprising:

a tray support having a bottom wall, opposing side walls, and a rear wall thereby forming a generally rectangular shape with an open top and an open front, and a first plurality of spaced projections on said opposing side walls;

a tray adjustable for insertion within said open front of said generally rectangular shaped tray support to variable positions therein, said tray having a bottom wall, opposing side walls, and a front wall thereby forming a generally rectangular shape with an open top and open back; and a second plurality of spaced projections on said tray opposing side walls for removably and matingly engaging at least one of said first spaced projections on said tray support in a locking relationship so as to enable said tray to be made adjustable in position by unlocking said mating engagement of said tray and said tray support projections, moving said tray to a new position, and re-engaging at least one of said first and second plurality of spaced projections to lock said tray in said new position.

9. The adjustable width tray of claim 8 wherein said first and second pluralities of spaced projections comprise opposed triangular shaped teeth that matingly engage with each other in locking relationship to hold said tray in a fixed position within said tray support.

10. An adjustable width tray comprising:

a tray support having a generally rectangular shape and having at least opposing side walls and a rear wall;

a tray having a generally rectangular shape and having at least opposing side walls, and a front wall, said tray being telescopically inserted in said tray support in tray support side wall-to-tray side wall relationship; and a plurality of projections integrally formed with and forming a part of each of said tray support side walls and a part of each said tray side walls in opposing relationship for engaging each other in a locked, fixed relationship in any one of a plurality of extended positions thereby preventing movement of said tray from its selected position.

11. A method of forming an adjustable width tray comprising the steps of:

forming a tray support having opposed side walls, an integrally formed bottom panel, and an integrally formed rear wall;

forming each of said opposed side walls with an inner wall and an outer wall, said inner side wall extending only partially downwardly along said outer wall, said inner side wall having a lower edge;

associating a first plurality of spaced projections with said lower edge of said inner side wall;

forming a tray having at least opposing side walls and a front wall, said tray having a dimension sufficient to enable it to be inserted in side wall-to-side wall relationship within said tray support, and associating a second plurality of corresponding spaced projections on each corresponding side wall of said tray for removable mating engagement with said spaced projections on said tray support inner side walls in a plurality of tray width positions to form an adjustable width tray.

12. The method of claim 11 further comprising the steps of:

forming a front edge on each of said tray support side walls;

forming an upper edge on each of said tray support side walls that slopes downwardly from said rear wall to said front edge; and forming each of said side walls with an inner wall and an outer wall with a space between said inner and outer wall.

13. The method of claim 12 further comprising the step of inserting said opposing side walls of said tray in corresponding ones of said spaces formed between said inner wall and said outer wall of corresponding ones of said tray support side walls.

14. The method of claim 13 further comprising the steps of:

extending said inner wall of each of said tray support side walls partially downwardly along said corresponding outer wall a predetermined distance to a lower edge; and forming said first plurality of spaced projections in relation to said lower edge of said inner walls of each tray support side walls for removable mating and locking engagement with at least one of said second plurality of spaced projections associated with corresponding sidewalls of said tray thereby enabling said tray to be positioned at adjustable widths within said tray support.

15. The method of claim 14 further comprising the step of forming said first and second plurality of spaced projections as triangular spaced teeth.

16. The tray of claims 8, 10, 7 or 11, in which the tray and the support are formed of a paperboard or corrugated paper material.

17. A paperboard or corrugated paper blank for forming a tray having only a bottom panel, opposing side walls, and a front wall, said tray forming a part of an adjustable width paperboard or corrugated tray and comprising:

said bottom panel;

an outer wall portion having first and second opposed edges and being integrally formed with said bottom panel about a score line forming said first edge and an inner wall portion having first and second opposed edges and integrally formed along its first edge with said second edge of said outer wall portion to form said front wall by folding said outer wall portion upwardly about its first edge connecting the outer wall portion to said bottom panel and by folding the inner wall portion inwardly and downwardly about its first edge connecting said inner and outer wall portions; and a first outer lip integrally formed with the inner wall portion about said second edge of said inner wall portion; and each side wall having an outer panel that folds upwardly about a connecting score line connecting said bottom panel and said outer panel; an inner panel that folds over said outer panel about a connecting score line and that extends at least partially downwardly toward said bottom panel; a second outer lip having an inner and an outer side and a first edge that connects said second outer lip to said inner panel, said second outer lip extending partially upwardly along said side wall inner panel with its inner side adjacent said inner panel; said second outer lip having a second opposing edge; spaced projections extending upwardly from the second opposing edge of said second outer lip; and a glue strip on the inner side of said second outer lip for adhering said inner side of said second outer lip to said inner side of said adjacent inner wall.

18. The paperboard or corrugated paper blank of claim, 17 further comprising:

each side wall outer wall having a side edge adjacent said front wall;

a flap integrally formed with and connected to each said side edge of each of said outer side wall portions by a connecting score line such that, when said paperboard or corrugated paper blank is folded to form said tray, each of said flaps is folded about a respective connecting score line and located between said inner side wall portion and said outer side wall portion of said front wall; said first outer lip on said front wall being folded about said score line connecting said first outer lip to said second edge of said inner front wall portion so as to be located between said side flaps and said outer side wall to securely lock said side flaps in place.

19. The paperboard or corrugated paper blank of claim 18 further comprising:

at least one projection in said score line connecting said inner side wall portion to said first outer lip; and at least one corresponding slot formed in said score line connecting said bottom panel to said outer side wall portion such that when said outer side wall portion is folded upwardly about said score line connecting it to said bottom panel and when said inner side wall portion is folded downwardly about said score line connecting it to said outer side wall portion, said at least one projection is inserted in said at least one corresponding slot to maintain said inner side wall portion adjacent said outer side wall portion.

20. An adjustable tray comprising:

a first section having three side walls, a bottom and a first engagement portion;

a second section having three side walls, a bottom and a second engagement portion for engaging said first engagement portion, said second engagement portion having a configuration with a repeated pattern wherein when said first and said second sections are brought together, they form a four sided tray and said first engagement portion is engaged with said second engagement portion in an adjustable manner allowing said tray to expand, to contract and to be held in a selected position;

said first engagement portion is adhered to two of said three side walls of said first section; and said second engagement portion is adhered to two of said three side walls of said second section.

21. The tray of claim 20 wherein:

said first section telescopes into said second section when said sections are brought together.

22. The tray of claim 20 wherein:

said first section is formed from a first sheet of paper board or corrugated paper;

said second section is formed from a second sheet of paper board or corrugated paper;

said second engagement portion is periodic;

said first engagement is a repeated and periodic pattern;

said first section telescopes into said second section.

23. The tray of claim 22 wherein:

said first engagement portion engages said second engagement portion in an abutting relationship when said first and said second sections are brought together.

* * * * *